US008381913B2

(12) United States Patent
Rem et al.

(10) Patent No.: US 8,381,913 B2
(45) Date of Patent: Feb. 26, 2013

(54) METHOD AND APPARATUS FOR SEPARATING PARTS, IN PARTICULAR SEEDS, HAVING DIFFERENT DENSITIES

(75) Inventors: Peter Carlo Rem, Rijswijk (NL); Simon Peter Maria Berkhout, Delft (NL); Jacques Rene Alphons De Koning, Dinteloord (NL)

(73) Assignees: Technische Universiteit Delft, Delft (NL); Western Seed International B.V., Naaldwijk (NL)

( * ) Notice: Subject to any disclaimer, the term of this patent is extended or adjusted under 35 U.S.C. 154(b) by 100 days.

(21) Appl. No.: 12/853,061

(22) Filed: Aug. 9, 2010

(65) Prior Publication Data

US 2011/0049017 A1 Mar. 3, 2011

Related U.S. Application Data

(63) Continuation of application No. PCT/NL2009/050087, filed on Feb. 26, 2009.

(30) Foreign Application Priority Data

Feb. 27, 2008 (NL) ..... 2001322

(51) Int. Cl.
*B03B 5/00* (2006.01)

(52) U.S. Cl. ..... 209/155; 209/1; 209/3; 209/10; 209/156; 209/212

(58) Field of Classification Search ..... 209/3, 39, 209/40, 212, 223.1, 223.2, 12.1, 12.2, 38
See application file for complete search history.

(56) References Cited

U.S. PATENT DOCUMENTS

| | | | | |
|---|---|---|---|---|
| 1,522,343 | A | | 1/1925 | Thom |
| 2,056,426 | A | | 10/1936 | Frantz |
| 2,291,042 | A | | 7/1942 | Kennedy |
| 2,690,263 | A | | 9/1954 | Box et al. |
| 3,057,477 | A | | 10/1962 | Rappaport |
| 4,062,765 | A | * | 12/1977 | Fay et al. ..... 209/1 |
| 4,069,145 | A | | 1/1978 | Sommer |
| 4,083,774 | A | | 4/1978 | Hunter |
| 4,324,657 | A | * | 4/1982 | Garrett ..... 210/197 |
| 4,621,928 | A | * | 11/1986 | Schreiber ..... 366/137 |
| 4,623,470 | A | * | 11/1986 | Adler ..... 210/787 |
| 4,743,364 | A | | 5/1988 | Kyrazis |
| 4,874,507 | A | * | 10/1989 | Whitlock ..... 209/11 |
| 5,011,022 | A | * | 4/1991 | Palepu et al. ..... 209/155 |
| 5,224,604 | A | * | 7/1993 | Duczmal et al. ..... 209/12.2 |
| 5,957,298 | A | | 9/1999 | Buske et al. |
| 5,968,820 | A | * | 10/1999 | Zborowski et al. ..... 435/325 |
| 6,138,833 | A | | 10/2000 | Matsufuji et al. |

(Continued)

FOREIGN PATENT DOCUMENTS

| | | |
|---|---|---|
| AU | 726763 | 11/2000 |
| DE | 729487 | 12/1942 |

(Continued)

*Primary Examiner* — Terrell Matthews
(74) *Attorney, Agent, or Firm* — Jeffrey D. Myers; Peacock Myers, P.C.

(57) ABSTRACT

A method for separating seeds of different densities in a process stream, wherein the seeds are introduced into a magnetic process fluid for the formation of the process stream, which process stream is subjected to a magnetic field for the realization of a density stratification in the process stream, such that the individual seeds in the process stream assume a density-dependent position, after which the seeds located in or near a predetermined position or positions in the process stream, are separated from the remaining seeds in the process stream.

6 Claims, 2 Drawing Sheets

U.S. PATENT DOCUMENTS

| | | | | |
|---|---|---|---|---|
| 6,568,612 | B1 | 5/2003 | Aoki et al. | |
| 6,708,828 | B2 | 3/2004 | Miles | |
| 6,822,180 | B2 | 11/2004 | Fujii et al. | |
| 7,741,574 | B2 * | 6/2010 | Stencel et al. | 209/128 |
| 2003/0044832 | A1 * | 3/2003 | Blankenstein | 435/6 |
| 2003/0165812 | A1 * | 9/2003 | Takayama et al. | 435/4 |
| 2004/0050756 | A1 | 3/2004 | Flagan | |
| 2009/0047297 | A1 * | 2/2009 | Kim et al. | 424/184.1 |
| 2009/0301296 | A1 * | 12/2009 | Hoijtink et al. | 95/35 |
| 2011/0042274 | A1 | 2/2011 | Rem et al. | |
| 2011/0049017 | A1 * | 3/2011 | Rem et al. | 209/3 |

FOREIGN PATENT DOCUMENTS

| | | |
|---|---|---|
| DE | 1051752 | 3/1959 |
| DE | 4014969 | 5/1990 |
| DE | 102004040785 | 3/2006 |
| DE | 102005032661 | 7/2007 |
| EP | 1181982 | 2/2002 |
| EP | 1800753 | 6/2007 |
| EP | 1878505 | 1/2008 |
| FR | 1348410 | 12/1964 |
| GB | 1602279 | 11/1981 |
| GB | 679277 | 9/2005 |
| OA | 392 | 10/1964 |
| WO | WO-0126793 | 4/2001 |
| WO | WO-03053588 | 7/2003 |
| WO | WO-2006021410 | 3/2006 |
| WO | WO-2006138314 | 12/2006 |

* cited by examiner

METHOD AND APPARATUS FOR SEPARATING PARTS, IN PARTICULAR SEEDS, HAVING DIFFERENT DENSITIES

CROSS-REFERENCE TO RELATED APPLICATIONS

This application is a continuation application of International Patent Application Serial No. PCT/NL2009/050087 entitled "Method and Apparatus for Separating Parts, in Particular Seeds, Having Different Densities", to Technische Universiteit Delft and Western Seed International B.V., filed on Feb. 26, 2009, which is a continuation of Netherlands Patent Application Serial No. 2001322, entitled "Method and Apparatus for Separating Parts, in Particular Seeds, Having Different Densities", to Technische Universiteit Delft and Western Seed International B.V., filed on Feb. 27, 2008, and the specification and claims thereof are incorporated herein by reference.

STATEMENT REGARDING FEDERALLY SPONSORED RESEARCH OR DEVELOPMENT

Not Applicable

INCORPORATION BY REFERENCE OF MATERIAL SUBMITTED ON A COMPACT DISC

Not Applicable

COPYRIGHTED MATERIAL

Not Applicable

BACKGROUND OF THE INVENTION

1. Field of the Invention

The present invention relates to a method and apparatus for separating particles of different densities, in particular seeds, in a process stream of a magnetic process fluid.

2. Description of Related Art

From the European patent application EP-A-I 800 753 a method and apparatus for separating solid particles in a process fluid are known, wherein the magnetic fluid is conducted through a magnetic field, generated by means of permanent magnets.

This known method and apparatus is suitable for separating solid particles of greatly differing densities, wherein the density difference of the solid particles may be 1000 kg/m$^3$ or more, as for example copper being 8900 kg/m$^3$ in comparison with aluminum being 2700 kg/m$^3$. Such particles are separated from each other by strong forces with the result that turbulence in the process fluid or the possibility of clustering particles, due to sedimentation hardly influence the separation of the solid particles.

BRIEF SUMMARY OF THE INVENTION

In a first aspect of the invention, a method for separating seeds of different densities in a process stream is proposed, which is characterized in that the seeds are introduced into a magnetic process fluid for the formation of the process stream, which process stream is subjected to a magnetic field for the realization of a density stratification in the process stream, such that the individual seeds in the process stream assume a density-dependent position, after which the seeds located in or near a predetermined position or positions in the process stream, are separated from the remaining seeds in the process stream.

In a second aspect of the invention, a method is proposed, which is characterized in that the particles or seeds are introduced into a turbulent first partial flow of the process fluid, which turbulent first partial flow is added to a laminar second partial flow of the process fluid for the formation of the process stream, which process stream is subjected to a magnetic field for the realization of a density-stratification in the process stream, such that the individual seeds in the process stream assume a density-dependent position, after which the seeds located in or near a predetermined position or positions in the process stream are separated from the remaining seeds in the process stream.

DETAILED DESCRIPTION OF THE INVENTION

Figure 1:
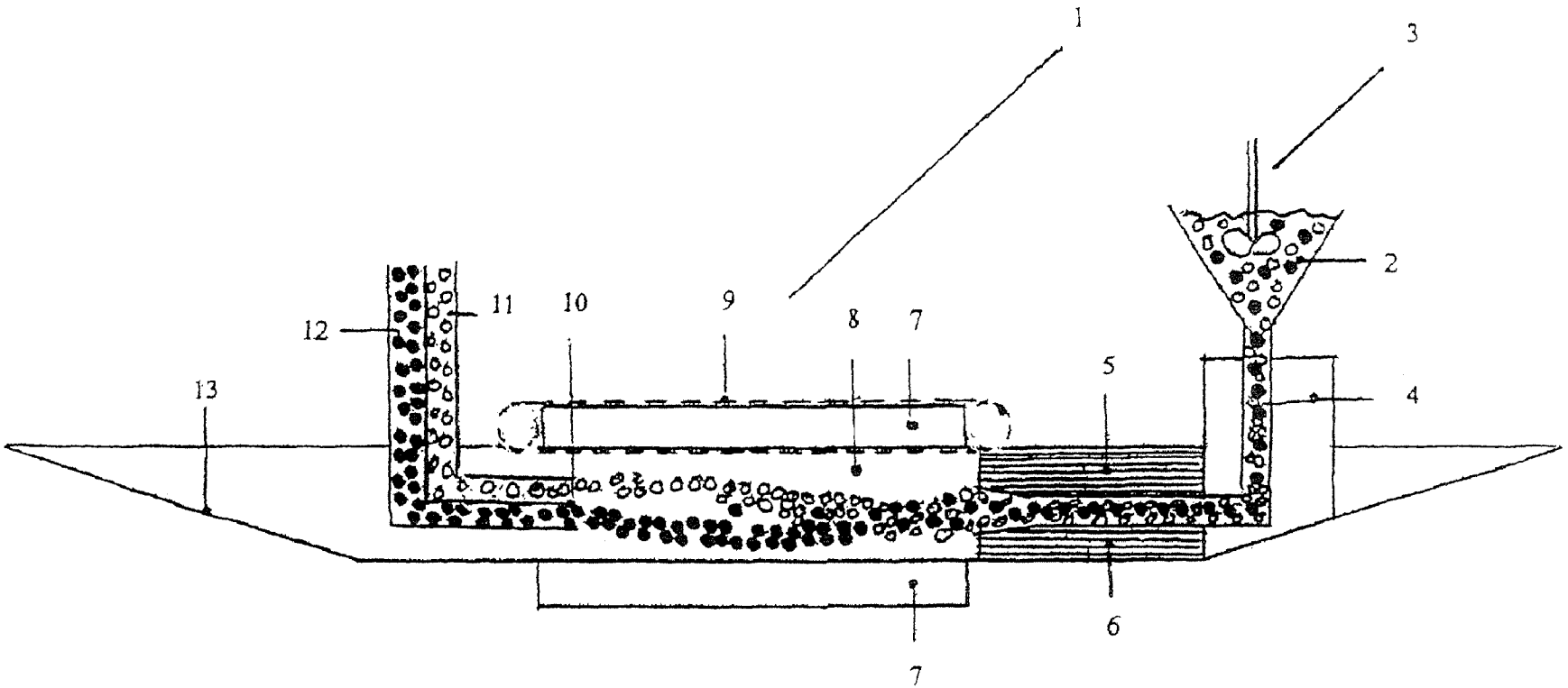
FIG. 1, a schematic representation of an embodiment of the apparatus according to the invention.

The method of the present invention may be effectively realized in an apparatus, which is characterized by a feed organ for introducing the particles or seeds into a turbulent first partial flow of the process fluid, through a laminator for producing a laminar second partial flow delimiting the first partial flow on at least two sides, and wherein the first partial flow and the second partial flow together form the process stream and that in the process stream after the organ that generates the magnetic field, a separating organ is provided.

It has been shown that when separating solid particles such as seeds of small density differences, in the order of up to 10 kg/m$^3$, turbulence in the process fluid is very disadvantageous. The above-mentioned measures limit the turbulence of the total process stream in the magnetic field to a minimum, while in addition allowing the particles or seeds to start near or at the height of the separating organ, such that the distance they have to travel (in the vertical direction) in order to be recovered at the desired side of the separating organ, is minimal.

It should further be noted, that it is also possible to use a multiple separating organ with which the particles or seeds can be divided into, for example, a maximum of 10 different density fractions.

The method and apparatus according to the present invention thus fulfill the practical need of being able to separate seeds that differ little in density.

Before joining the two streams, it is desirable for the seeds that are to be separated to be mixed with a first partial flow that is significantly smaller than the second partial flow, which is in a laminar flow condition. The combined process fluids are subsequently subjected to a magnetic field causing a vertical density distribution to occur in the process stream. As a result, the seeds will float at the level in the process steam that corresponds with the density of the particular seeds. Subsequently, using a customary separating organ that is part of the apparatus, the seeds can be divided into the desired density fractions and the seeds can be removed from the process stream.

The process fluid from which the particles or seeds have been removed is then preferably conducted back into the system for reuse.

The present method is particularly suitable for separating seeds of a density of, for example, 600-1500 kg/ma$^3$.

The process fluid of the process stream according to the invention usually consists of a suspension of iron oxide particles in water or kerosene, and the first partial flow to which the particles or seeds to be separated have been admixed, preferably constitutes approximately 10% of the total process stream.

In contrast with the Dutch patent 1 030 761, in which only the use of permanent magnets is mentioned, good separation results are according to the present method obtained by using one or several permanent magnets, electromagnets or superconducting magnets for generating the magnetic field.

It is particularly useful to pre-moisten the solid particles or seeds so as to, when mixing the seeds into the turbulent first partial flow, prevent the adherence to the particles or seeds of air bubbles, which would make them effectively lighter and relatively heavy seeds would incorrectly end up in a lighter particle fraction.

Hereinafter the invention will be further elucidated by way of a non-limiting exemplary embodiment and with reference to the drawings.

Referring first to FIG. 1, an apparatus 1 is shown in accordance with the invention. The apparatus 1 possesses an organ 7 for generating a magnetic field for separating particles or seeds. To this end the seeds are, after preferably having been moistened, introduced into a mixing vessel 2 and are, preferably using a stirrer 3, thoroughly mixed in order to obtain from this mixing vessel 2 a turbulent first partial flow 4 of the process fluid. The apparatus is, moreover, embodied such that a second partial flow 8 is provided, which due to the use of a laminator 5, 6, is of a laminar nature. It is desirable for the feed organ 2 from which the first partial flow 4 is obtained, to discharge into the laminator 5, 6 such that during operation, the laminar second partial flow 8 is located above and below the turbulent first partial flow 4, and thus delimits this first partial flow 4.

The first partial flow 4 with the seeds and the second partial flow 8 delimiting the same, jointly flow through an area in which a magnetic field is present, generated by the organ 7 for generating the magnetic field.

In order to maintain the laminar flow of the second partial flow 8, it is further desirable for the same to be delimited by at least one endless conveyor belt or belts 9, 13, which during operation delimits the second partial flow 8. The endless conveyor belts 9, 13 move at a rate that is adjusted to, and substantially corresponds with, the flow rate of the second partial flow 8.

It will be obvious that there is an endless conveyor belt 9 at the upper side of the second partial flow 8 as well as an endless conveyor belt 13 at the lower side of the second partial flow 8. This latter endless conveyor belt 13 is then preferably designed such that it is able to carry away settled seeds.

FIG. 1 further shows that the process stream composed of the first partial flow 4 and the second partial flow 8, is conducted in the direction of a separating organ 10, as symbolized by the arrow 13. At the separating organ 10 the delivered seeds are divided into density fractions, with the white lighter seeds being located higher up in the process stream and the black heavier seeds below them. For the sake of clarity, the separating organ 10 is only represented in an embodiment for dividing into two density fractions. It will, however, be obvious that this may be extended as desired so that the seeds can be divided into, for example, maximally 10 density fractions.

It is further remarked, perhaps unnecessarily, that the laminator 5, 6 is provided at the feed side of the process stream before the organ 7 generating the magnetic field, and that this organ 7 generating the magnetic field may be selected as required from the group comprising a permanent magnet, an electromagnet or a superconducting magnet.

The intensity of the magnetic field can be adjusted as required, in accordance with the concentration of magnetisable particles in the process stream. In practice, this field intensity varies between 0.001-1 Tesla, preferably 0.10-0.15 Tesla. The density of the magnetisable particles in the process stream may in practice vary between 1 kg and 300 kg/m$^3$, amounting to a concentration in the range of 0.1%-30%. For the process fluid, from which the first partial flow 4 and the second partial flow 8 are obtained, kerosene may be used. However, it is common practice to use water for this purpose. The magnetisable particles to be introduced into this fluid are preferably provided with a coating in order to effectively prevent clustering of these particles.

Suitable magnetisable particles are iron oxide particles. Other kinds of magnetisable particles, if used, usually have disadvantages with respect to their burdening the environment. The size of the magnetisable particles may vary widely. Diameters of 1 nm to 1 mm are mentioned, with a preference for the range of 10 nm-100 μm.

The method and apparatus according to the invention are preferably used for separating seeds having a density of 600-1500 kg/m$^3$. In accordance therewith the magnetic field intensity to be used should be chosen within the frame of the above mentioned preconditions concerning the process fluid possibly to be used and the desirable density variation of this process fluid when applying the magnetic field.

A suitable choice of the rate of the process stream through the magnetic field may be a sluggish flow rate ranging from 0.00001-10 m/s, preferably 0.01 to 1 m/s.

After separation, the seeds are preferably washed and/or dried.

Figure 2:
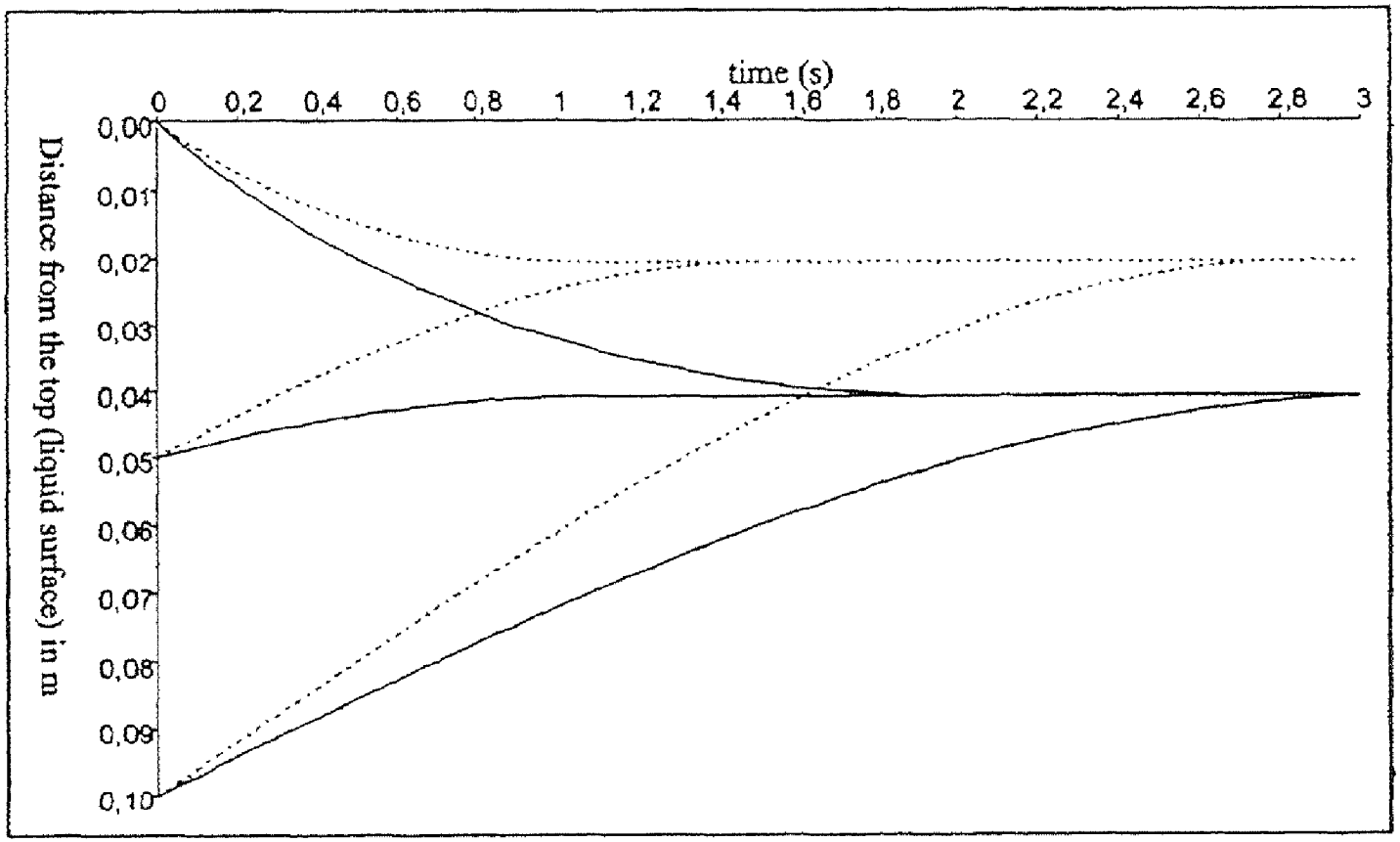
FIG. 2, some simulated trajectories of particles separated in the apparatus according to FIG. 1.

FIG. 2 shows the simulated trajectories of three pairs of particles with laminar conditions in a fluid process stream, maintained in an apparatus according to the invention. The solid lines relate to relatively heavy particles and the broken lines relate to relatively light particles. The results show that the separation is most efficient when the particles to be separated are introduced in a small turbulent stream of approximately 10% into the process fluid stream, preferably approximately at the height of the separating organ, which provides a particularly good separation of the particles.

What is claimed is:

1. An apparatus having an organ for generating a magnetic field for separating solid particles, in particular seeds, from a process stream of a magnetic process fluid maintained during operation in the apparatus, wherein the process stream is formed from a first turbulent partial flow and a second laminar partial flow, wherein the first partial flow and the second partial flow together form the process stream, after which the process stream is conducted past the organ generating the magnetic field, comprising a feed organ for introducing the seeds into the turbulent first partial flow of the process fluid, and a laminator for producing the laminar second partial flow delimiting the first partial flow on at least two sides, and wherein a separating organ is provided in the process stream after the organ generating the magnetic field.

2. An apparatus according to claim 1, wherein the feed organ discharges into the laminator such that during operation the laminar second partial flow is located above and below the turbulent first partial flow.

3. An apparatus according to claim 1, wherein at least one endless conveyor belt is provided, which during operation delimits the laminar second partial flow.

4. An apparatus according to claim 3, wherein in relation to the second partial flow, a conveyor belt is provided at the lower side, designed for carrying away settled seeds.

5. An apparatus according to claim 1, wherein the laminator is provided at the feed side of the process stream before the organ generating the magnetic field.

6. An apparatus according to claim 1, wherein the organ generating the magnetic field is a permanent magnet, an electromagnet or a superconducting magnet.

* * * * *